US009243334B2

(12) United States Patent
Matsushima et al.

(10) Patent No.: US 9,243,334 B2
(45) Date of Patent: Jan. 26, 2016

(54) METHOD AND APPARATUS FOR MANUFACTURING SI-CONTAINING COLD ROLLED STEEL SHEETS

(75) Inventors: Tomohiro Matsushima, Chiba (JP); Masao Inose, Kawasaki (JP); Masayasu Nagoshi, Chiba (JP); Hiroyuki Masuoka, Fukuyama (JP); Shigeyuki Aizawa, Chiba (JP); Hisato Noro, Kawasaki (JP)

(73) Assignee: JFE STEEL CORPORATION, Tokyo (JP)

( * ) Notice: Subject to any disclaimer, the term of this patent is extended or adjusted under 35 U.S.C. 154(b) by 301 days.

(21) Appl. No.: 14/008,353

(22) PCT Filed: Mar. 26, 2012

(86) PCT No.: PCT/JP2012/058776

§ 371 (c)(1),
(2), (4) Date: Sep. 27, 2013

(87) PCT Pub. No.: WO2012/133869

PCT Pub. Date: Oct. 4, 2012

(65) Prior Publication Data

US 2014/0013814 A1 Jan. 16, 2014

(30) Foreign Application Priority Data

Mar. 28, 2011 (JP) ..... 2011-070793
Mar. 16, 2012 (JP) ..... 2012-061063

(51) Int. Cl.
*C23G 3/02* (2006.01)
*C23G 1/08* (2006.01)
(Continued)

(52) U.S. Cl.
CPC ..... *C23G 3/027* (2013.01); *C22C 38/02* (2013.01); *C22C 38/04* (2013.01); *C22C 38/06* (2013.01);
(Continued)

(58) Field of Classification Search
CPC ..... C22C 38/02; C22C 38/04; C22C 38/06; C21D 8/0473; C21D 8/0478; C23G 1/00; C23G 1/08; C23G 1/081; C23G 1/085; C23G 1/086; C23G 1/088; C23G 3/021; C23G 3/027
USPC ..... 72/39
See application file for complete search history.

(56) References Cited

U.S. PATENT DOCUMENTS 4,415,858 A 11/1983 Hale
5,092,393 A * 3/1992 Suehiro ..... C21D 8/0205 164/476

(Continued)

FOREIGN PATENT DOCUMENTS

JP A 60-52737 3/1985
JP A 5-317949 12/1993

(Continued)

OTHER PUBLICATIONS

Aug. 26, 2014 Search Report issued in European Patent Application No. 12764994.5.

(Continued)

*Primary Examiner* — David B Jones
(74) *Attorney, Agent, or Firm* — Oliff PLC

(57) ABSTRACT

This invention provides methods and apparatuses which can manufacture Si-containing cold rolled steel sheets exhibiting excellent chemical conversion properties even if a chemical conversion treatment solution is used at a lower temperature while minimally suppressing the generation of sludge as well as reducing running costs. The method includes steps of cold rolling a steel containing 0.5 to 3.0 mass % Si, continuously annealing the cold rolled steel sheet, pickling the surface of the continuously annealed cold rolled steel sheet, and repickling the surface of the pickled steel sheet with a non-oxidative acid. The repickling is performed such that a repickling solution is sampled continuously or periodically, an acid concentration in the sampled solution is measured, and the acid concentration in the repickling solution is regularly controlled within a prescribed concentration range.

18 Claims, 6 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C23G 1/00*** | (2006.01) |
| *C21D 8/04* | (2006.01) |

(52) U.S. Cl.

CPC .. *C23G 1/00* (2013.01); *C23G 1/08* (2013.01); *C23G 1/081* (2013.01); *C23G 1/085* (2013.01); *C23G 1/086* (2013.01); *C23G 1/088* (2013.01); *C23G 3/021* (2013.01); *C21D 8/0473* (2013.01); *C21D 8/0478* (2013.01)

(56) References Cited

U.S. PATENT DOCUMENTS

| | | | | |
|---|---|---|---|---|
| 5,800,694 | A | 9/1998 | Starcevic et al. | |
| 6,266,983 | B1 * | 7/2001 | Takada | G01N 29/11 72/11.1 |
| 6,835,487 | B2 * | 12/2004 | Takao | C22C 38/004 428/595 |
| 8,806,910 | B2 * | 8/2014 | Jin | B21B 45/06 29/81.03 |
| 2002/0146348 | A1 | 10/2002 | Rodabaugh et al. | |
| 2013/0149526 | A1 * | 6/2013 | Masuoka | C21D 8/0236 428/332 |
| 2013/0149529 | A1 * | 6/2013 | Masuoka | C21D 8/0205 428/336 |
| 2014/0013814 | A1 * | 1/2014 | Matsushima | C23G 1/081 72/39 |

FOREIGN PATENT DOCUMENTS

| | | |
|---|---|---|
| JP | A 5-320952 | 12/1993 |
| JP | A 6-104878 | 4/1994 |
| JP | B2 3046132 | 5/2000 |
| JP | A 2000-313979 | 11/2000 |
| JP | A 2002-146561 | 5/2002 |
| JP | B2 3321289 | 9/2002 |
| JP | A 2004-256896 | 9/2004 |
| JP | A-2005-200697 | 7/2005 |
| JP | A-2005-248272 | 9/2005 |
| JP | A 2007-126747 | 5/2007 |
| JP | B2 4319559 | 8/2009 |
| JP | A 2009-221586 | 10/2009 |

OTHER PUBLICATIONS

May 29, 2012 Search Report issued in International Patent Application No. PCT/JP/058776 (with translation).

* cited by examiner

METHOD AND APPARATUS FOR MANUFACTURING SI-CONTAINING COLD ROLLED STEEL SHEETS

TECHNICAL FIELD

This invention relates to methods and apparatuses for manufacturing Si-containing cold rolled steel sheets. In particular, this invention relates to methods and apparatuses for manufacturing Si-containing cold rolled steel sheets that allow for stable manufacturing of Si-containing cold rolled steel sheets exhibiting excellent chemical conversion properties. Specifically, the methods and apparatuses control with high accuracy the acid concentration during repickling in which the concentration can change widely.

BACKGROUND ART

An improvement of fuel efficiency of vehicles has been recently demanded from the viewpoint of global environmental conservation. In addition, improvements in automobile safety have been required in order to protect passengers in the event of a crash. Thus, demands have been placed on both weight saving and strengthening of car bodies, and thinning and strengthening of automobile parts have been recently pursued.

Because a lot of automobile parts are manufactured by press forming of steel sheets, it has been strongly demanded that steel sheets used for automobile parts exhibit excellent press formability as well as high strength. Solid solution strengthening by the addition of Si is a known technique which increases the strength of steel sheets without a marked deterioration in press formability.

However, solid solution strengthening has a problem in that if a large amount, in particular, 0.5 mass % or more, of Si is added to cold rolled steel sheets, Si-containing oxides such as $SiO_2$ (silica) and $SiMnO_3$ (manganese silicate) are formed on the surface of steel sheets during annealing. These Si-containing oxides inhibit the surface of steel sheets from being etched during zinc phosphate treatment (chemical conversion treatment) performed as a base treatment before the steel sheets are electrodeposition coated. Consequently, formation of sound chemical conversion film is inhibited. When such high-strength cold rolled steel sheets having a high Si content are exposed, after being electrodeposition coated, to severe environments such as hot saline water immersion tests or complex cycle corrosion tests in which the steel sheets are wetted and dried repeatedly, the coatings are stripped easily as compared to usual steel sheets. That is, post-coating corrosion resistance deteriorates easily.

Many proposals have been made of methods for improving the chemical conversion properties of Si-containing steel sheets, in particular, steel sheets having a high Si content of not less than 0.5 mass %.

Patent Literature 1 proposes a technique in which Mn/Si ratio is controlled to be not less than 1.2 so as to suppress formation of inactive Si oxides on the surface and to promote generation of active Mn oxides. Thereby, good chemical conversion property is realized even in the case of box annealing of high-Si steel.

Patent Literature 2 proposes a technique in which good chemical conversion property is obtained by attaching 20 to 1500 mg/m$^2$ of iron to the surface of sufficiently clean cold rolled steel sheets, although the mechanism of this effect is not fully understood.

Patent Literature 3 proposes a technique directed to improve chemical conversion properties by controlling the rate of coverage on the steel sheet surface by Si oxides and the size of Si oxide. The technique controls the dew point during continuous annealing to 0° C. to −20° C. and Si oxides on the surface layer are removed with concentrated hydrochloric acid or concentrated sulfuric acid after the continuous annealing.

Patent Literature 4 proposes a technique in which a portion of steel sheet extending 1 μm or more from the surface on each side is removed by pickling to eliminate all the oxides present in the steel. Thereby, excellent chemical conversion properties are obtained.

Patent Literature 5 proposes a method in which Si oxides formed on the surface of steel sheet during annealing are removed by pickling and immediately thereafter the steel sheet is brought into contact with a sulfur compound. As a result, the number of zinc phosphate crystal nuclei is increased. Thereby, the size of zinc phosphate crystals is reduced and the density of zinc phosphate crystals is increased and thus chemical conversion properties are improved.

Before the steel sheets obtained in accordance with these literatures are subjected to chemical conversion treatments, surfaces of the steel sheets are usually pickled with acids to remove oxide layers present on the surfaces of the steel sheets after the continuous annealing. In the case where the pickling is performed continuously, the acid concentration in the pickling solution is decreased with the consumption of acids and consequently the pickling performance decreases. In order to prevent the decrease in the pickling performance of the pickling solution and to ensure a constant pickling performance, it is necessary that the acid concentration in the pickling solution is measured on a regular basis and the supplementary acids are added to the pickling solution.

The following analytical methods have been known as methods for the regular measurement of acid concentration in a pickling solution. For example, measuring the concentration of nitric acid in a mixed acid containing nitric acid and hydrofluoric acid is most commonly performed by first determining the total acid concentration in the pickling solution by a neutralization titration method and thereafter subtracting the hydrofluoric acid concentration from the total acid concentration. As the analytical methods for determining the latter concentration, namely, the hydrofluoric acid concentration, for example, Patent Literatures 6 and 7 describe an absorbance method based on discoloration of iron acetylacetone complex and an analytical method based on an ion electrode method, respectively.

CITATION LIST

Patent Literature

[PTL 1] Japanese Examined Patent Application Publication No. 06-104878

[PTL 2] Japanese Unexamined Patent Application Publication No. 5-320952

[PTL 3] Japanese Patent No. 4319559

[PTL 4] Japanese Unexamined Patent Application Publication No. 2009-221586

[PTL 5] Japanese Unexamined Patent Application Publication No. 2007-126747

[PTL 6] Japanese Patent No. 3321289

[PTL 7] Japanese Patent No. 3046132

SUMMARY OF INVENTION

Technical Problem

It is a recent trend to use chemical conversion treatment solutions at lower temperatures in order to reduce the amounts of industrial wastes (suppress the formation of sludge) and to save running costs. Consequently, the reactivity of chemical conversion treatment solutions with respect to steel sheets is very low compared to that under conventional chemical conversion treatment conditions.

Thus, it has been demanded that the acid concentration during pickling is controlled within a very narrow range of concentration in order to achieve stable chemical conversion properties while minimally suppressing the generation of sludge as well as saving running costs. This control requires rapid and highly accurate analysis.

Patent Literatures 1 to 5, which disclose techniques for achieving excellent chemical conversion properties, essentially entail removal of oxide layer on the steel sheet surface by pickling. In the techniques described in Patent Literatures 6 and 7, on the other hand, measurement of acid concentration takes a long time. Accordingly, when a large amount of acids is consumed, i.e., when, for example, a large quantity of steel strip is continuously pickled, the pickling solution cannot be conditioned quickly and appropriately. As a result, the acid concentration falls below the lower limit of the control range, resulting in pickling problems.

Further, acids may be added in excess in order to ensure that the pickling performance will not fall below the lower limit of control range. This can result in overpickling and also increases costs.

In process analysis in the iron and steel manufacturing field, an accurate acid concentration is not necessarily required in some cases. That is, a clear indication of a certain correlation between the analytical values and the acid concentrations is sufficient. However, the ion electrode method described in literature such as Patent Literature 7 has a high probability that the correlation is destroyed due to metals present in the pickling solution.

In the technique described in Patent Literature 7, the hydrofluoric acid concentration is determined by an ion electrode method and thus the analysis is quick. However, because the nitric acid concentration is analyzed by a neutralization titration method, it takes a long time to obtain both the nitric acid concentration and the hydrofluoric acid concentration. Thus, this technique has a problem in terms of the quickness.

An ion electrode method is quicker than neutralization titration method or iron acetylacetone complex discoloration absorbance method. However, the analysis accuracy is lowered in, for example, iron and steel pickling lines due to the influences of various metal ions such as Fe which are present in large amounts in the pickling solution.

When steel sheets having undergone strong pickling are transferred to a repickling tank, water is sprayed to the steel sheets to prevent the steel sheets from becoming dry. This is because the steel sheets become rusted and changed in color by drying of acids attached to the steel sheets. Of the amount of water sprayed to the steel sheets, however, the major proportion of water except the portion of water serving to keep the steel sheets wet is allowed to drop into the repickling tank. Accordingly, the acid concentration in the repickling tank becomes lowered. Because of this as well as because the acid concentration is lowered due to the consumption of acids in the repickling tank by the pickling of steel sheets, the acid concentration in the repickling tank decreases very rapidly.

If a steel sheet is subjected to continuous repickling in an actual step without controlling the acid concentration, for example, the rate of decrease in the acid concentration in a repickling tank can be as high as 1 g/L per 30 minutes. In the case of strong pickling, the decrease of acids in the strong pickling tank is slightly faster than in the case of the repickling tank and can be as fast as 2 g/L per 30 minutes. Because pickling in a strong pickling tank has a purpose of simply removing an oxide layer, strict control of the acid concentration in accordance with the types of steel is not necessary. Acceptable upper and lower limits of control range of acid concentration are the target concentration plus or minus about 15 g/L. Considering the amount of decrease of acids and the acceptable upper and lower limits of control range, analysis and adjustment of the acid concentration will appropriately take place after about every 3 hours in the case of a strong pickling tank.

In contrast, the acid concentration in a repickling tank should be controlled in accordance with the types of steel because this pickling is final and directly determines chemical conversion properties. The limits of control range of acid concentration are much narrower than that in strong pickling tank. That is, for example, the limits of control range are the target value plus or minus 1 g/L in the use of hydrochloric acid. Because acids in a repickling tank can decrease at a rate as high as about 1 g/L per 30 minutes, the acid concentration may fall outside the control range relative from the target value in 30 minutes. Thus, the analysis should be completed at least in about 20 minutes in consideration of times required for operations such as adding the supplemental acids after the analysis.

After the consideration of the rate of decrease in the acid concentration and the limits of control range of acid concentration as discussed above, it has been found that the acid concentration in a repickling tank should be analyzed and adjusted with a shorter period than in a strong pickling tank in order to ensure the chemical conversion properties stably for a long period.

This invention has been made in view of the aforementioned problems encountered in the manufacturing of cold rolled steel sheets containing large amounts of Si. An object of this invention is to provide methods and apparatuses which can manufacture Si-containing cold rolled steel sheets exhibiting excellent chemical conversion properties even if a chemical conversion treatment solution is used at a lower temperature while minimally suppressing the generation of sludge as well as reducing running costs.

Solution to Problem

The inventors carried out extensive studies on methods for increasing the reactivity between the surface of steel sheet and chemical conversion treatment solutions. As a result, the inventors have found that it is very important that (i) the surface of continuously annealed steel sheet is strongly pickled to completely remove Si-containing oxide layer formed on the surface of steel sheet during annealing and that (ii) the surface of the steel sheet is further repickled to remove iron-containing oxides formed on the surface of steel sheet by the strong pickling. The inventors further carried out extensive studies on methods for stably achieving chemical conversion properties in production steps. As a result, the inventors have found that, in order to stably remove oxide layers by strong pickling and repickling as well as to achieve saving in running costs, it is very important that the acid concentration in the treatment solution is measured quickly and controlled within a narrow concentration range during the treatment, in particular, during the repickling. This invention has been completed based on these findings.

This invention solves the aforementioned problems by providing a method for manufacturing Si-containing cold rolled steel sheets which includes steps of cold rolling a steel sheet containing 0.5 to 3.0 mass % Si, continuously annealing the cold rolled steel sheet, pickling a surface of the continuously annealed cold rolled steel sheet, repickling the surface of the pickled steel sheet with a non-oxidative acid, wherein the repickling is performed such that a repickling solution is sampled continuously or periodically, an acid concentration in the sampled solution is measured, and the acid concentration in the repickling solution is regularly controlled within a prescribed concentration range.

Here, the acid concentration in the repickling solution may be measured by one of a near-infrared spectroscopic analysis method, a glass electrode method, and an electromagnetic induction method.

The acid concentration in the repickling solution may be measured after the sampled pickling solution is passed through a filter.

Further, this invention provides an apparatus for manufacturing Si-containing cold rolled steel sheets with excellent chemical conversion properties, which includes a pickling tank for pickling a surface of a steel sheet that is cold rolled and continuously annealed, a repickling tank for repickling the surface of the pickled steel sheet with a non-oxidative acid, a measurement unit for continuously or periodically sampling a repickling solution and measuring an acid concentration in the sampled solution, and a unit for regularly controlling the acid concentration in the repickling tank within a prescribed concentration range based on the measurement results.

Here, the measurement unit utilized one of a near-infrared spectroscopic analysis method, a glass electrode method, and an electromagnetic induction method.

The measurement unit may include a filter for removing suspended solids before the acid concentration in the sampled solution is measured.

A pore diameter of the filter may be not less than 20 μm and not more than 30 μm.

The acid used in the repickling may be one of hydrochloric acid, sulfuric acid, phosphoric acid, pyrophosphoric acid, formic acid, acetic acid, citric acid, hydrofluoric acid, oxalic acid and mixtures of two or more of these acids.

The acid used in the repickling may be one of hydrochloric acid with a concentration of 0.1 to 50 g/L, sulfuric acid with a concentration of 0.1 to 150 g/L, and a mixture of hydrochloric acid and sulfuric acid with respective concentrations of 0.1 to 20 g/L and 0.1 to 60 g/L.

The repickling may be performed at a temperature of the repickling solution of 20 to 70° C. for a repickling time of 1 to 30 seconds.

The pickling may be performed using a pickling solution that is a mixture of nitric acid with a concentration of more than 50 g/L and not more than 200 g/L and hydrochloric acid with a concentration of more than 1 g/L and not more than 200 g/L, or a mixture of nitric acid with a concentration of more than 50 g/L and not more than 200 g/L and hydrofluoric acid with a concentration of more than 1 g/L and not more than 200 g/L.

The acid concentration in the pickling solution may be measured with lower accuracy and/or at a longer interval compared with the accuracy and the interval for measuring the acid concentration in the repickling solution.

Advantageous Effects of Invention

According to this invention, it becomes possible to measure the acid concentration in a repickling solution quickly and with high accuracy. Accordingly, the concentration of the repickling solution can be adjusted so rapidly that a control of the concentration within a narrow range becomes feasible. As a result, a probability that the acid concentration of a repickling solution gets out of the control range is considerably reduced. Thus, this invention allows for the manufacturing of Si-containing cold rolled steel sheets with excellent chemical conversion properties in such a way that the generation of sludge is minimally suppressed and running costs are saved.

DESCRIPTION OF EMBODIMENTS

Hereinbelow, embodiments of this invention will be described in detail with reference to drawings.

The continuous annealing results in formation of large amounts of Si-containing oxides such as $SiO_2$ and Si—Mn complex oxides on the surface of steel sheets. The presence of such oxides drastically deteriorates chemical conversion properties and post-coating corrosion resistances. Thus, in the manufacturing method of this invention, annealed cold rolled steel sheets are strongly pickled with an acid such as nitric acid so as to remove the Si-containing oxide layer on the surface of steel sheet together with a base iron layer.

Of the Si-containing oxides, Si—Mn complex oxides are easily dissolved in acids, whereas $SiO_2$ exhibits low solubility in acids. Thus, complete removal of Si-containing oxides including $SiO_2$ requires that the steel sheet is strongly pickled to remove the oxide layer together with a base iron layer. Nitric acid that is a strongly oxidative acid may be favorably used for the strong pickling. However, types of acids are not particularly limited as long as the acid can remove the Si-containing oxide layer. Thus, other acids such as hydrofluoric acid, hydrochloric acid, and sulfuric acid may be used. It is also effective to promote dissolution of base iron layer by adding pickling promoters to the acids or by performing electrolysis in combination with the pickling.

Figure 1:
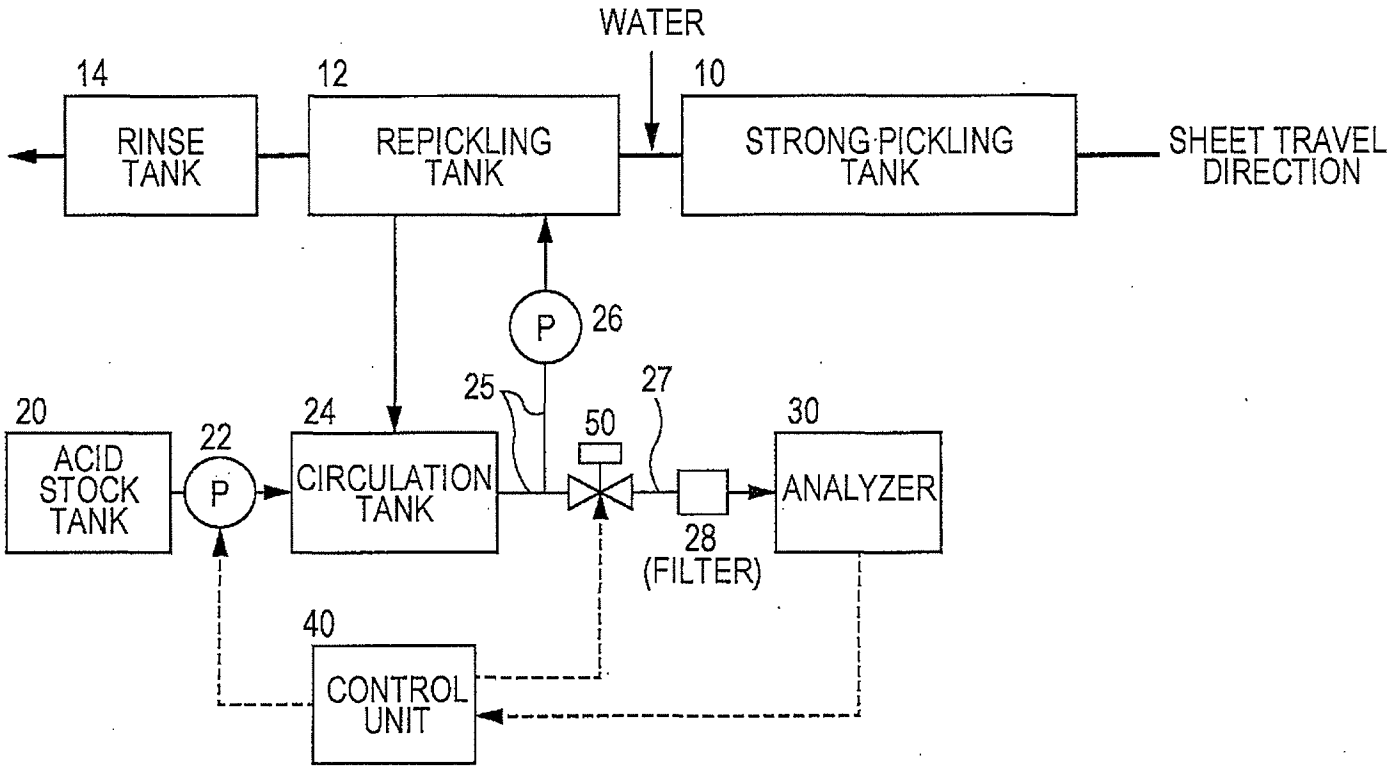
FIG. 1 illustrates manufacturing steps in an embodiment of this invention.

In the manufacturing of Si-containing cold rolled steel sheets according to this invention, as illustrated in FIG. 1, a steel material (slab) containing 0.5 to 3.0 mass % Si is heated, hot rolled, cold rolled and continuously annealed. The annealed steel sheet is passed through a strong pickling solution in a strong pickling tank 10 containing an acid such as nitric acid. Thereby the Si-containing oxide layer present on the surface of the steel sheet is completely removed.

In order to remove the Si containing oxide layer from the surface of continuously annealed steel sheet as well as to reduce the load in repickling described later, it is preferable to suppress an amount of iron containing oxides formed on the surface of steel sheet due to the strong pickling, which is performed after the continuous annealing and before the repickling. For this purpose, the pickling is preferably carried out using a strong pickling solution that is a mixture of nitric acid and hydrochloric acid, which is capable of destroying surface oxide film, with their concentrations of above 50 g/L and not more than 200 g/L and above 1 g/L and not more than 200 g/L. The pickling may also be preferably carried out using a mixture of nitric acid and hydrofluoric acid with their concentrations of above 50 g/L and not more than 200 g/L and above 1 g/L and not more than 200 g/L.

When the above strong pickling solutions are used, the pickling is preferably performed at a temperature of the strong pickling solution of 20 to 70° C. for a pickling time of 3 to 30 seconds.

Pickling with a strong pickling solution such as a mixture of nitric acid and hydrochloric acid or a mixture of nitric acid and hydrofluoric acid, however, forms iron-containing oxides on the surface of the steel sheet. Thus, this invention provides that the steel sheet is further repickled with a non-oxidative acid to dissolve and remove the iron-containing oxides.

Due to the pickling in the strong pickling tank 10, iron-containing oxides are formed on the surface of steel sheet. The steel sheet discharged from the strong pickling tank 10 is sprayed with water at the exit of the strong pickling tank 10 so that the steel sheet is prevented from becoming dry before entering a repickling tank 12. The steel sheet is then repickled in a repickling tank 12 with an acid such as hydrochloric acid. This repickling removes the iron-containing oxides resulting from the pickling in the strong pickling tank 10.

Examples of the non-oxidative acids which may be used in the repickling include hydrochloric acid, sulfuric acid, phosphoric acid, pyrophosphoric acid, formic acid, acetic acid, citric acid, hydrofluoric acid, oxalic acid and mixtures of two or more of these. Although any of these acids may be utilized, hydrochloric acid and sulfuric acid, which are generally used in the iron making industry, may be preferably used. In particular, hydrochloric acid is favorable because of the reasons including (1) residues such as sulfate radicals, which remains in the case that sulfuric acid is used, do not remain on the steel sheet surface after rinsing because hydrochloric acid is volatile, and (2) chloride ions are highly effective for dissociating oxides. A mixture of hydrochloric acid and sulfuric acid may also be utilized.

When hydrochloric acid is used as a pickling solution for repickling in the repickling tank 12, the pickling solution preferably has a hydrochloric acid concentration of 0.1 to 50 g/L. In the case of sulfuric acid, the sulfuric acid concentration is preferably 0.1 to 150 g/L. When a mixture of hydrochloric acid and sulfuric acid is used in the repickling, the acid mixture preferably has a hydrochloric acid concentration of 0.1 to 20 g/L and a sulfuric acid concentration of 0.1 to 60 g/L.

Irrespective of which of above repickling solutions is used, the repickling in this invention is preferably performed at a temperature of the repickling solution in a range of 20 to 70° C. for a treatment time of 1 to 30 seconds.

The removal of iron-containing oxides remaining on the steel sheet surface is sufficient when the concentration of the repickling solution is not less than the lower limit described above, the solution temperature is not less than 20° C., and the treatment time is not less than 1 second. On the other hand, the steel sheet surface is not dissolved excessively and an oxide film is newly formed on the surface when the concentration of the repickling solution is not more than the upper limit concentration, the temperature is not more than 70° C., and the treatment time is not more than 30 seconds.

As illustrated in FIG. 1, an acid is supplied from an acid stock tank 20 to a circulation tank 24 through a pump 22 and is circulated between the repickling tank 12 and the circulation tank 24 through a pump 26. A portion of the repickling solution is filtered through a filter 28 to remove suspended solids from the solution, and the sampled solution is introduced into an analyzer 30 to measure an acid concentration in the repickling solution.

Figure 2:
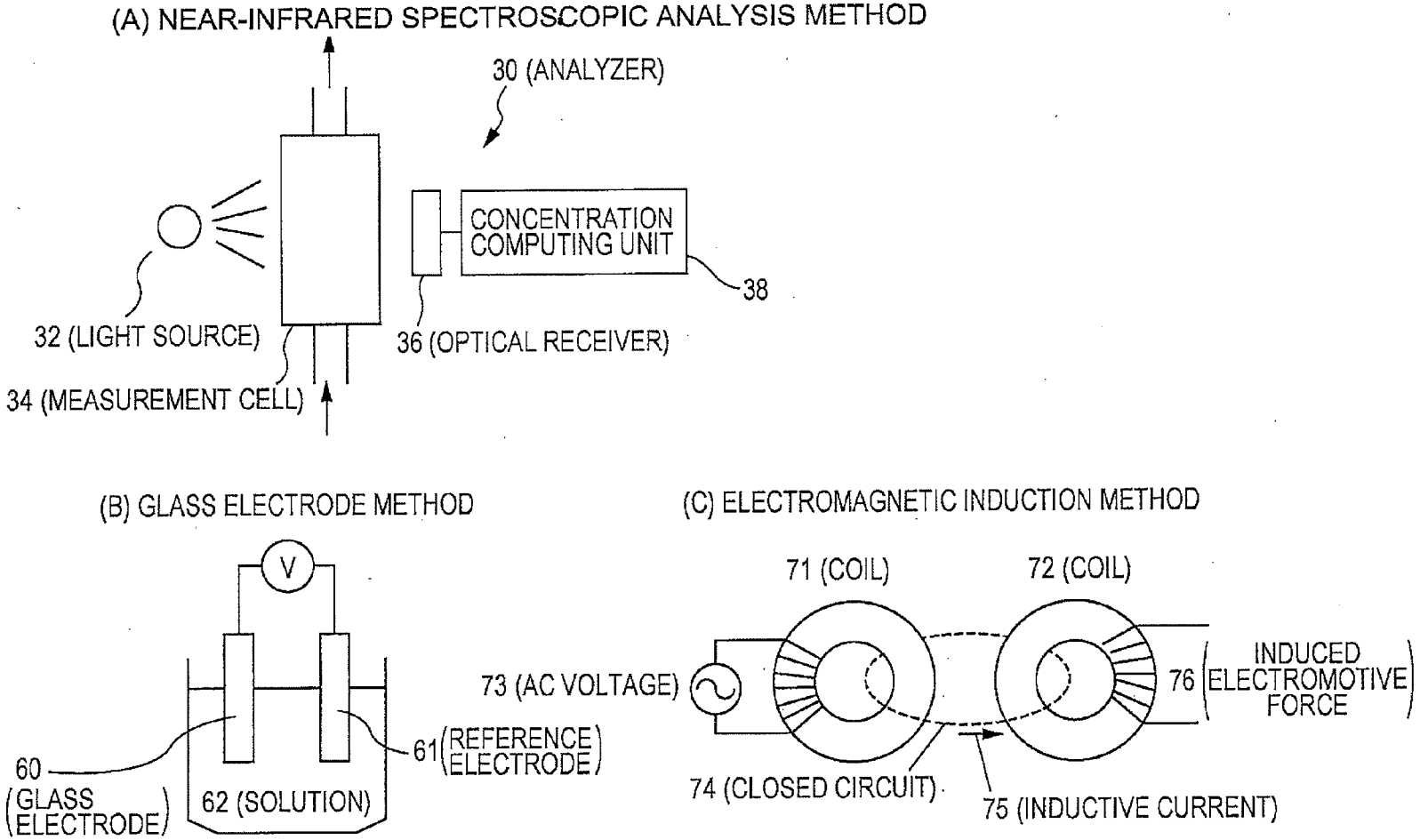
FIG. 2 illustrates basic configurations of analyzers used in the embodiment.

The analyzer 30 may preferably utilize a technique capable of performing a more accurate analysis than the techniques utilized in Patent Literatures 6 and 7. For example, as illustrated in FIG. 2, it is desirable to use analyzers based on one of a near-infrared spectroscopic analysis method (A), a glass electrode method (B), and an electromagnetic induction method (C).

The strong pickling is used for the purpose of simply removing an oxide layer. Accordingly, this step does not have to be controlled strictly in accordance with types of the steel, and an acceptable range in the controlling of acid concentration is about plus or minus 15 g/L from a target concentration. In contrast, the repickling is the final pickling step and directly determines chemical conversion properties. Accordingly, the repickling step should be controlled in accordance with types of the steel and the limits of control range of the acid concentration are much narrower than that in the strong pickling. For example, the limits of control range are plus or minus 1 g/L from a target value when hydrochloric acid is used.

An amount of acid in the repickling tank can decrease at a rate as high as about 1 g/L per 30 minutes. In order to control the acid concentration within limits of control range of plus or minus 1 g/L, the analysis should be completed within about 20 minutes, at the longest, in consideration of times required for operations such as adding supplemental acid after the analysis.

Controlling of the acid concentration in a repickling tank with an automated neutralization titrator, which is commonly used in the process analysis, is difficult because conventional automated neutralization titrators require at least about 30 minutes for the analysis. In view of this, it is desirable to use analyzers based on one of a near-infrared spectroscopic analysis method, a glass electrode method, and an electromagnetic induction method. These analytical techniques are capable of measuring the acid concentration within 10 minutes.

A near-infrared spectroscopic analysis method illustrated in FIG. 2(A) involves a light source 32, a measurement cell 34, an optical receiver 36 and a concentration computing unit 38. Usually, the light source 32 emits light in a near-infrared region having wavelengths of 0.7 to 2.5 μm. The light is absorbed by the solution to be analyzed in the measurement cell 34 while the transmitted light is analyzed by the detector 36. Thus, an absorption spectrum after transmission is measured. The concentration computing unit 38 has calibration curves preliminarily prepared with respect to absorption spectra of standard solutions or the like, and calculates the concentration by comparing the measured absorption spectrum to the calibration curves. A known near-infrared spectroscopic analysis method may be used as long as these functions are met.

A glass electrode method illustrated in FIG. 2(B) utilizes a glass electrode 60 and a reference electrode 61. These electrodes are immersed in a solution 62 to measure a difference V between a potential of the glass electrode 60 and a potential of the reference electrode 61. The potential difference V is converted to a pH value based on a preliminarily prepared calibration curve that indicates a relation between the pH value of standard solutions or the like and the potential. Thereby, the pH value of the solution 62 is obtained. The hydrogen concentration is obtained with use of this pH value based on the definition pH=−log M (M is the molar concentration of hydrogen), and the acid concentration in the solution is calculated. A known pH meter may be used as long as the above functions are met.

An electromagnetic induction method illustrated in FIG. 2(C) utilizes a coil 71 and a coil 72. When these coils are immersed in a solution, a closed circuit 74 that intersects both of the two coils 71 and 72 is formed. The application of an AC voltage 73 to the coil 71 allows an inductive current 75 to flow through the closed circuit 74 in proportion to the electrical conductivity of the solution. At this moment, an induced electromotive force 76 is generated across the coil 72 in proportion to the magnitude of the inductive current. The electrical conductivity of the solution can be obtained from this induced electromotive force 76. Then, the acid concentration of the solution is determined based on a preliminarily prepared calibration curve that represents the relation between the electrical conductivity and the acid concentration of standard solutions or the like. A known concentration meter, which is called as an electromagnetic concentration meter, may be used.

The acid concentration in the strong pickling tank 10, which does not widely vary, may be manually analyzed by an operator using an appropriate technique such as the techniques described in Patent Literature 6 or 7, or may be analyzed using the same analyzers that may be used for the analysis of the acid concentration in the repickling tank 12.

Because the limits of control range in the strong pickling tank 10 are as wide as plus or minus 15 g/L, and the rate of decrease in the acid concentration is about 2 g/L per 30 minutes at most, the acid concentration in the strong pickling tank 10 may be measured at an interval of up to about 3 hours from a process analysis point of view. The load on an operator performing the analysis is so small that the acid concentration may be measured manually by using a method such as a neutralization titration method or an ion electrode method described in Patent Literature 6 or 7, or an absorptiometer. Further, controlling of the acid concentration is sufficiently possible even with an automated neutralization titrator that requires about 30 minutes for analysis.

Installation of the filter 28 is desirable in order to pass the solution from the repickling tank 12 therethrough and remove suspended solids such as sludge. The filter 28 may be made of any of known and commonly used materials as long as the filter is not corroded or dissolved by the acid to be analyzed. The filter 28 may be disposed at any location provided that suspended solids can be removed before the acid concentration in the sampled repickling solution is measured by the analyzer 30.

Specifically, the filter may be provided between the circulation tank 24 and the analyzer 30. In order to prevent the occurrence of blockage due to suspended solids as much as possible, the filter may be desirably provided in the course of a pipe 27 which branches off from a pipe 25 between the circulation tank 24 and the repickling tank 12 toward the analyzer 30.

The pore diameter of the filter 28 is desirably not less than 20 μm and not more than 30 μm. Filters having a pore diameter of less than 20 μm catch small-size suspended solids and become blocked in a short time. If the pore diameter is larger than 30 μm, suspended solids which have passed through the filter exert influences on the analysis and render accurate measurement infeasible.

In accordance with the analytical results provided by the analyzer 30, a control unit 40 performs a feedback control of the pump 22, and the supplemental acid is added from the acid stock tank 20 to the circulation tank 24. In this manner, the acid concentration in the repickling tank 12 is controlled within a narrow range.

In FIG. 1, a rinse tank 14 is provided for cleaning the steel sheet after the repickling.

The composition of the Si-containing cold rolled steel sheet suited in this invention may desirably contain following components in addition to Si.

C: 0.01 to 0.30 Mass %

Carbon is an effective element for increasing the strength of steel as well as for forming retained austenite, which has TRIP (transformation induced plasticity) effect and bainite and martensite. These effects are obtained when the C content is not less than 0.01 mass %. A decrease in weldability is avoided when the C content is not more than 0.30 mass %. Thus, the C content is preferably in the range of 0.01 to 0.30 mass %, and more preferably 0.10 to 0.20 mass %.

Mn: 1.0 to 7.5 Mass %

Manganese is an element that increases the strength of steel by solid solution strengthening and also enhances hardenability. Further, manganese has an effect of promoting the formation of retained austenite, bainite and martensite. These effects are obtained when the Mn content is not less than 1.0 mass %. The above effects are obtained without an increase in costs when the Mn content is not more than 7.5 mass %. Thus, the Mn content is preferably in the range of 1.0 to 7.5 mass %, and more preferably 2.0 to 5.0 mass %.

P: Not More than 0.05 Mass %

Phosphorus has limited adverse effects on drawability relative to its high solid solution strengthening effects and is thus an effective element for achieving an increase in strength. It is preferable that this element is included in a content of not less than 0.005 mass %. Although phosphorus impairs spot weldability, the inclusion of this element is not problematic as long as the content is not more than 0.05 mass %. Thus, P content is preferably not more than 0.05 mass %, and more preferably not more than 0.02 mass %.

S: Not More than 0.005 Mass %

Sulfur, which is an inevitable impurity, is a harmful component because it precipitates as MnS in steel to lower the stretch flangeability of steel sheets. In order to avoid a decrease in stretch flangeability, S content is preferably not more than 0.005 mass %, and more preferably not more than 0.003 mass %.

Al: Not More than 0.06 Mass %

Aluminum is used as a deoxidizes during steelmaking steps and is also effective for separating nonmetallic inclusions which are detrimental to stretch flangeability as slag. It is therefore preferable that this element is included in 0.01 mass % or more. The above effects can be obtained without an increase in material costs as long as the Al content is not more than 0.06 mass %. Thus, Al content is preferably not more than 0.06 mass %, and more preferably in the range of 0.02 to 0.06 mass %.

The balance other than the above components is Fe and inevitable impurities. However, the steel sheets may separately contain one of the following elements or may contain a plurality of the following elements in combination for the reasons described below within a range or ranges that the functions and effects of this invention is achieved. Titanium, niobium and vanadium form carbides and nitrides and suppress the growth of ferrite during heating for annealing, and thus reduce the size of the microstructure and improve formability, in particular, stretch flangeability. Thus, one, or two or more of these elements may be added within the ranges of Ti: 0.005 to 0.3 mass %, Nb: 0.005 to 0.3 mass %, and V: 0.005 to 0.3 mass %. Molybdenum improves the hardenability of steel and promotes the formation of bainite and martensite. Thus, molybdenum may be added in the range of 0.005 to 0.3 mass %. Calcium and REM (rare earth metals) control the configurations of sulfide inclusions and improve the stretch flangeability of steel sheets. Thus, one or both of Ca: 0.001 to 0.1 mass % and REM: 0.001 to 0.1 mass % may be added.

In the manufacturing method of this invention, steel having the above chemical composition is smelted in a furnace such as a converter furnace or an electric furnace, subjected to secondary refining with an RH vacuum degasser, and thereafter formed into a steel slab by an ingot making-blooming method or a continuous casting method. In order to prevent the occurrence of segregation in the slab and to stabilize the material quality, a continuous casting method is preferable.

The subsequent hot rolling is usually performed after the slab is temporarily cooled to room temperature and is reheated in a heating furnace to a temperature of not less than 1000° C. An alternative method is a direct-feed rolling (direct rolling) method in which the slab that has been casted (continuously casted) is directly rolled without being reheated. Still alternatively, the slab may be introduced into a heating furnace as a warm piece without being cooled to room temperature, and may be rolled after being lightly heated or being kept warm. When the slab is heated, the heating temperature for the slab is desirably not less than 1000° C. Although the upper limit is not particularly limited, heating at a temperature exceeding 1300° C. increases the weight of oxides and can result in an increase in scale loss or the occurrence of surface defects. Thus, the upper limit is desirably 1300° C. When the slab is charged into a heating furnace as a warm piece, similarly, the slab temperature is desirably not less than 1000° C.

The hot rolling is desirably carried out in such a manner that the slab is roughly rolled as required and is thereafter finish rolled into a hot rolled sheet at a finishing temperature of not less than 800° C. If the finishing temperature is less than 800° C., the microstructure of the steel sheet becomes non-uniform and workability is lowered. On the other hand, the upper limit of the finishing temperature is not particularly limited. However, it is desirable that the finishing temperature be not more than 1000° C. because rolling at an excessively high temperature can cause surface defects such as scale marks. After hot rolling, the steel sheet is preferably coiled at a temperature of not more than 650° C. Coiling at a temperature exceeding 650° C. results in the generation of large amounts of scales after coiling, thus increasing the load in pickling before cold rolling.

The hot rolled sheet obtained as described above is descaled by a treatment such as pickling, shot blasting or brush grinding, and is thereafter subjected to cold rolling. This cold rolling is not particularly limited as long as a cold rolled sheet having desired size and shape can be obtained. From the viewpoints of surface flatness and the uniformity of microstructure, the steel sheet is desirably rolled with a draft of not less than 20%. The pickling before cold rolling may be omitted when the scale present on the surface of the hot rolled sheet is sufficiently thin.

After the cold rolling, the cold rolled sheet is subjected to annealing in a continuous annealing line in order to attain desired strength and workability. In this continuous annealing, the steel sheet is desirably annealed by being held at temperatures in the range of 750 to 900° C. If the holding temperature during heating is less than 750° C., recrystallization does not take place sufficiently and workability is lowered. On the other hand, holding at a temperature exceeding 900° C. results in the coarsening of the microstructure and deteriorates the balance between strength and ductility. The holding time at the above temperature is preferably not less than 30 seconds, and in order to attain uniform quality of steel sheets, is preferably not less than 60 seconds, and more preferably not less than 120 seconds.

In this invention, it is preferable that the dew point of the ambient is not more than −20° C. during the time when the steel sheet is heated in the continuous annealing. If the dew point exceeds −20° C., the surface of the steel sheet becomes so markedly decarburized that the material quality is adversely affected. The dew point is more preferably not more than −25° C.

EXAMPLE 1

A steel containing 0.125 mass % C, 1.5 mass % Si, 2.6 mass % Mn, 0.019 mass % P, 0.005 mass % S and 0.040 mass % Al, the balance being Fe and inevitable impurities, was smelted by a usual refining process involving a converter furnace and treatments such as degassing. The steel was continuously cast to give a steel material (slab). Subsequently, the slab was reheated to a temperature of 1150 to 1170° C., hot rolled at a finishing temperature of 850 to 880° C., and coiled at a temperature of 500 to 550° C., thus producing a hot rolled steel sheet having a sheet thickness of 3 to 4 mm. The hot rolled steel sheet was then descaled by pickling and was cold rolled into a cold rolled steel sheet having a sheet thickness of 1.8 mm. Next, the cold rolled steel sheet was subjected to continuous annealing in which the steel sheet was heated to a soaking temperature of 750 to 780° C., held at the temperature for 40 to 50 seconds, thereafter cooled from the soaking temperature to a cooling finish temperature of 350 to 400° C. at 20 to 30° C./sec, and held at a temperature in the range of the above cooling finish temperatures for 100 to 120 seconds. Thereafter, the surface of the steel sheet was strongly pickled and was further repickled. Table 1 describes pickling conditions and repickling conditions. The surface of the steel sheet was then cleaned with water and dried, and the steel sheet was temper rolled with 0.7% elongation. In this manner, cold rolled steel sheets were obtained.

TABLE 1

| Pickling conditions | | | Repickling conditions | | |
|---|---|---|---|---|---|
| Acid conc. [g/l] | Temp. [° C.] | Treatment time [sec] | Acid conc. [g/l] | Temp. [° C.] | Treatment time [sec] |
| Nitric acid: 150 + Hydrochloric acid: 15 | 40 | 10 | Hydrochloric acid: 0.1 | 40 | 1 |
| | | | | | 10 |
| | | | | | 30 |
| | | | Hydrochloric acid: 10 | 20 | 1 |
| | | | | | 10 |
| | | | | | 30 |

TABLE 1-continued

| Pickling conditions | | | Repickling conditions | | |
|---|---|---|---|---|---|
| Acid conc. [g/l] | Temp. [° C.] | Treatment time [sec] | Acid conc. [g/l] | Temp. [° C.] | Treatment time [sec] |
| | | | Hydrochloric acid: 10 | 40 | 1 |
| | | | | | 10 |
| | | | | | 30 |
| | | | Hydrochloric acid: 10 | 70 | 1 |
| | | | | | 10 |
| | | | | | 30 |
| | | | Hydrochloric acid: 50 | 40 | 1 |
| | | | | | 10 |
| | | | | | 30 |
| | | | Hydrochloric acid: 100 | 40 | 1 |
| | | | | | 10 |
| | | | | | 30 |
| | | | Sulfuric acid: 0.1 | 40 | 1 |
| | | | | | 10 |
| | | | | | 30 |
| | | | Sulfuric acid: 100 | 40 | 1 |
| | | | | | 10 |
| | | | | | 30 |
| | | | Sulfuric acid: 150 | 40 | 1 |
| | | | | | 10 |
| | | | | | 30 |
| | | | Sulfuric acid: 200 | 40 | 1 |
| | | | | | 10 |
| | | | | | 30 |

Controlling of acid concentration in the repickling tank 12, which is provided after the continuous annealing and the strong pickling in the above described manufacturing of steel sheets, is performed by using following procedures.

Based on an instruction from a control unit 40, a switching valve 50 was opened so that the pickling solution would be introduced into an analyzer 30. The pickling solution was passed through a filter 28 to remove suspended solids such as sludge. The filter size was 30 μm. The repickling solution cleaned of suspended solids was introduced into the analyzer 30 and was analyzed by a near-infrared spectroscopic analysis method to determine the acid concentration. The obtained concentration data was transmitted to the control unit 40, and a pump 22 was operated in accordance with the obtained concentration data to supply the acid from the acid stock tank 20 containing fresh acid to the circulation tank 24. The acid concentration was controlled by circulating the pickling solution between the circulation tank 24 and the repickling tank 12.

In the above process, the repickling solution was analyzed at an interval of 10 minutes. The above steps were performed automatically via a control of the control unit 40.

Test pieces were collected from the respective cold rolled steel sheets obtained in the above manner, and were subjected to chemical conversion treatments and coating treatments under conditions described below. Thereafter, post-coating corrosion resistances were evaluated by using three types of corrosion tests: hot saline water immersion test, saline water spray test, and complex cycle corrosion test.

EXAMPLE 2

Test pieces were prepared in the same manner as in EXAMPLE 1 and were evaluated by the same tests as in EXAMPLE 1, except that the repickling solution was analyzed by using a glass electrode method to determine the acid concentration.

EXAMPLE 3

Test pieces were prepared in the same manner as in EXAMPLE 1 and were evaluated by the same tests as in EXAMPLE 1, except that the repickling solution was analyzed by using an electromagnetic induction method to determine the acid concentration.

(1) Conditions in Chemical Conversion Treatment

Test pieces sampled from the respective cold rolled steel sheets were chemically converted using degreaser FC-E2011, surface conditioner PL-X and chemical conversion treatment agent PALBOND PB-L3065, all manufactured by Nihon Parkerizing Co., Ltd., under either of the following two conditions, namely, standard conditions and comparative conditions in which the temperature of the chemical conversion treatment liquid was decreased to a lower temperature. The chemical conversion treatment was carried out such that a nominal amount of the chemical conversion coating was 1.7 to 3.0 g/m$^2$.

<Standard Conditions>

Degreasing step: treatment temperature 40° C., treatment time 120 seconds

Spray degreasing, surface conditioning step: pH 9.5, treatment temperature room temperature, treatment time 20 seconds Chemical conversion treatment step: chemical conversion treatment agent temperature 35° C., treatment time 120 seconds <Lower Temperature Conditions>

The temperature of the chemical conversion treatment agent in the above standard conditions was lowered to 33° C.

(2) Corrosion Tests

Surfaces of the chemically converted test pieces were electrodeposition coated by using electrodeposition coating paint V-50 manufactured by NIPPON PAINT Co., Ltd. such that a nominal film thickness was 25 μm. The electrodeposition coated test pieces were subjected to following three corrosion tests.

<Hot Saline Water Immersion Test>

The surface of the chemically converted and electrodeposition coated test piece (n=1) was cut with a cutter to form a crosscut mark of 45 mm in length. The test piece was then immersed in a 5 mass % NaCl solution (60° C.) for 360 hours, washed with water, and dried. A pressure-sensitive adhesive tape was attached to a cut mark area and was thereafter peeled. After this tape peel-off test, the maximum overall width of peeling extending both left and right from the cut mark was measured. The corrosion resistance in the hot saline water immersion test may be evaluated to be good when the maximum overall width of peeling is not more than 5.0 mm.

<Saline Water Spray Test (SST)>

The surface of the chemically converted and electrodeposition coated test piece (n=1) was cut with a cutter to form a crosscut mark 45 mm in length. The test piece was then sprayed with a 5 mass % aqueous NaCl solution for 1200 hours in accordance with a neutral saline water spray test specified in JIS Z2371: 2000. A crosscut mark area was subjected to a tape peel-off test, and the maximum overall width of peeling extending both left and right from the cut mark was measured. The corrosion resistance in the saline water spray test may be evaluated to be good when the maximum overall width of peeling is not more than 4.0 mm.

<Complex Cycle Corrosion Test (CCT)>

The surface of the chemically converted and electrodeposition coated test piece (n=1) was cut with a cutter to form a crosscut mark of 45 mm in length. The test piece was then subjected to 120 cycles of testing each consisting of spraying a saline water (5 mass % aqueous NaCl solution: 35° C., relative humidity: 98%) for 2 hours→drying (60° C., relative humidity: 30%) for 2 hours→moistening (50° C., relative humidity: 95%) for 2 hours. After the corrosion test, the test piece was washed with water and dried. A cut mark area was subjected to a tape peel-off test, and the maximum overall width of peeling extending both left and right from the cut mark was measured. The corrosion resistance in the complex cycle corrosion test may be evaluated to be good when the maximum overall width of peeling is not more than 6.0 mm.

Results of above tests are shown in Tables 2 to 5 together with the conditions shown in Table 1. Tables 2, 3, 4, and 5 show results obtained with a near-infrared spectroscopic analysis method, results obtained with a conventional titration method, results obtained with a glass electrode method, and results obtained with an electromagnetic induction method, respectively.

TABLE 2

| | | | | | | Overall width of peeling after corrosion test [mm] Temperature of chemical conversion treatment liquid | | | | | |
|---|---|---|---|---|---|---|---|---|---|---|---|
| | | | | | | 35° C. | | 33° C. | | | |
| Pickling conditions | | | Repickling conditions | | | Hot saline water | Saline water | Complex cycle | | | |
| Acid conc. [g/L] | Temp. [° C.] | Treatment time [sec] | Acid conc. [g/L] | Temp. [° C.] | Treatment time [sec] | immersion test | spray test | corrosion test | | Results | Remarks |
| Nitric acid: 150 + Hydrochloric acid: 15 | 40 | 10 | Hydrochloric acid: 0.1 | 40 | 1 | 4.9 | 4.0 | 5.8 | 5.8 | ○ | INV. EX. |
| | | | | | 10 | 4.6 | 3.8 | 5.6 | 5.6 | ○ | INV. EX. |
| | | | | | 30 | 4.4 | 3.6 | 5.0 | 6.0 | ○ | INV. EX. |
| | | | Hydrochloric acid: 10 | 20 | 1 | 4.9 | 4.0 | 5.8 | 5.8 | ○ | INV. EX. |
| | | | | | 10 | 4.8 | 3.7 | 5.4 | 5.5 | ○ | INV. EX. |
| | | | | | 30 | 4.6 | 3.6 | 5.2 | 5.0 | ○ | INV. EX. |
| | | | Hydrochloric acid: 10 | 40 | 1 | 4.6 | 3.7 | 5.3 | 5.6 | ○ | INV. EX. |
| | | | | | 10 | 4.5 | 3.6 | 4.8 | 5.0 | ○ | INV. EX. |
| | | | | | 30 | 4.0 | 3.1 | 4.4 | 4.5 | ○ | INV. EX. |
| | | | Hydrochloric acid: 10 | 70 | 1 | 4.4 | 3.5 | 4.8 | 4.9 | ○ | INV. EX. |
| | | | | | 10 | 4.0 | 3.2 | 4.1 | 4.5 | ○ | INV. EX. |
| | | | | | 30 | 3.7 | 3.0 | 4.0 | 4.1 | ○ | INV. EX. |
| | | | Hydrochloric acid: 50 | 40 | 1 | 4.3 | 3.5 | 4.8 | 4.8 | ○ | INV. EX. |
| | | | | | 10 | 4.1 | 3.2 | 4.3 | 4.5 | ○ | INV. EX. |
| | | | | | 30 | 3.5 | 3.0 | 3.6 | 3.6 | ○ | INV. EX. |
| | | | Hydrochloric acid: 100 | 40 | 1 | 5.5 | 4.4 | 6.7 | 6.8 | X | COMP. EX. |
| | | | | | 10 | 5.7 | 4.7 | 7.1 | 7.4 | X | COMP. EX. |
| | | | | | 30 | 5.9 | 5.1 | 7.3 | 7.6 | X | COMP. EX. |
| | | | Sulfuric acid: 0.1 | 40 | 1 | 4.8 | 4.0 | 5.7 | 5.9 | ○ | INV. EX. |
| | | | | | 10 | 4.7 | 3.9 | 5.6 | 5.7 | ○ | INV. EX. |
| | | | | | 30 | 4.6 | 3.7 | 5.1 | 5.2 | ○ | INV. EX. |
| | | | Sulfuric acid: 100 | 40 | 1 | 4.7 | 3.9 | 5.5 | 5.7 | ○ | INV. EX. |
| | | | | | 10 | 4.5 | 3.7 | 5.3 | 5.5 | ○ | INV. EX. |
| | | | | | 30 | 4.2 | 3.4 | 5.0 | 5.2 | ○ | INV. EX. |
| | | | Sulfuric acid: 150 | 40 | 1 | 4.6 | 3.5 | 5.2 | 5.2 | ○ | INV. EX. |
| | | | | | 10 | 4.3 | 3.3 | 4.6 | 4.8 | ○ | INV. EX. |
| | | | | | 30 | 4.0 | 3.2 | 4.2 | 4.5 | ○ | INV. EX. |
| | | | Sulfuric acid: 200 | 40 | 1 | 5.4 | 4.4 | 6.6 | 6.8 | X | COMP. EX. |
| | | | | | 10 | 5.7 | 4.7 | 7.1 | 7.4 | X | COMP. EX. |
| | | | | | 30 | 6.0 | 5.2 | 7.4 | 7.6 | X | COMP. EX. |

TABLE 3

| Pickling conditions | | | Repickling conditions | | | Overall width of peeling after corrosion test [mm] Temperature of chemical conversion treatment liquid | | | | | |
|---|---|---|---|---|---|---|---|---|---|---|---|
| | | | | | | 35° C. | | 33° C. | | | |
| | | | | | | Hot saline water | Saline water | Complex cycle | | | |
| Acid conc. [g/L] | Temp. [° C.] | Treatment time [sec] | Acid conc. [g/L] | Temp. [° C.] | Treatment time [sec] | immersion test | spray test | corrosion test | | Results | Remarks |
| Nitric acid: 150 + Hydrochloric acid: 15 | 40 | 10 | Hydrochloric acid: 0.1 | 40 | 1 | 4.9 | 4.0 | 5.9 | 5.8 | ○ | INV. EX. |
| | | | | | 10 | 4.6 | 3.9 | 5.6 | 5.7 | ○ | INV. EX. |
| | | | | | 30 | 4.5 | 3.6 | 5.2 | 6.1 | ○ | INV. EX. |
| | | | Hydrochloric acid: 10 | 20 | 1 | 4.9 | 4.0 | 5.8 | 5.9 | ○ | INV. EX. |
| | | | | | 10 | 4.7 | 3.8 | 5.5 | 5.7 | ○ | INV. EX. |
| | | | | | 30 | 4.6 | 3.5 | 5.2 | 5.2 | ○ | INV. EX. |
| | | | Hydrochloric acid: 10 | 40 | 1 | 4.7 | 3.8 | 5.2 | 5.6 | ○ | INV. EX. |
| | | | | | 10 | 5.1 | 4.3 | 6.6 | 7.0 | X | INV. EX. |
| | | | | | 30 | 4.1 | 3.2 | 4.4 | 4.5 | ○ | INV. EX. |
| | | | Hydrochloric acid: 10 | 70 | 1 | 4.5 | 3.6 | 4.9 | 4.9 | ○ | INV. EX. |
| | | | | | 10 | 4.2 | 3.3 | 4.3 | 4.6 | ○ | INV. EX. |
| | | | | | 30 | 5.3 | 4.4 | 6.7 | 7.1 | X | INV. EX. |
| | | | Hydrochloric acid: 50 | 40 | 1 | 4.4 | 3.5 | 4.9 | 4.7 | ○ | INV. EX. |
| | | | | | 10 | 4.0 | 3.3 | 4.4 | 4.5 | ○ | INV. EX. |
| | | | | | 30 | 3.6 | 3.0 | 3.7 | 3.7 | ○ | INV. EX. |
| | | | Hydrochloric acid: 100 | 40 | 1 | 5.3 | 4.4 | 6.8 | 6.9 | X | COMP. EX. |
| | | | | | 10 | 5.6 | 4.8 | 7.2 | 7.2 | X | COMP. EX. |
| | | | | | 30 | 5.7 | 5.0 | 7.4 | 7.5 | X | COMP. EX. |
| | | | Sulfuric acid: 0.1 | 40 | 1 | 4.9 | 4.0 | 5.7 | 5.9 | ○ | INV. EX. |
| | | | | | 10 | 4.6 | 3.9 | 5.4 | 5.6 | ○ | INV. EX. |
| | | | | | 30 | 4.4 | 3.8 | 5.2 | 5.3 | ○ | INV. EX. |
| | | | Sulfuric acid: 100 | 40 | 1 | 4.7 | 3.8 | 5.6 | 5.6 | ○ | INV. EX. |
| | | | | | 10 | 5.2 | 4.3 | 6.8 | 7.4 | X | INV. EX. |
| | | | | | 30 | 4.0 | 3.3 | 4.9 | 5.1 | ○ | INV. EX. |
| | | | Sulfuric acid: 150 | 40 | 1 | 4.7 | 3.6 | 5.3 | 5.3 | ○ | INV. EX. |
| | | | | | 10 | 4.4 | 3.3 | 4.7 | 4.9 | ○ | INV. EX. |
| | | | | | 30 | 4.2 | 3.1 | 4.1 | 4.7 | ○ | INV. EX. |
| | | | Sulfuric acid: 200 | 40 | 1 | 5.5 | 4.5 | 6.5 | 6.8 | X | COMP. EX. |
| | | | | | 10 | 5.6 | 4.8 | 7.0 | 7.4 | X | COMP. EX. |
| | | | | | 30 | 5.8 | 5.2 | 7.4 | 7.6 | X | COMP. EX. |

TABLE 4

| Pickling conditions | | | Repickling conditions | | | Overall width of peeling after corrosion test [mm] Temperature of chemical conversion treatment liquid | | | | | |
|---|---|---|---|---|---|---|---|---|---|---|---|
| | | | | | | 35° C. | | 33° C. | | | |
| | | | | | | Hot saline water | Saline water | Complex cycle | | | |
| Acid conc. [g/L] | Temp. [° C.] | Treatment time [sec] | Acid conc. [g/L] | Temp. [° C.] | Treatment time [sec] | immersion test | spray test | corrosion test | | Results | Remarks |
| Nitric acid: 150 + Hydrochloric acid: 15 | 40 | 10 | Hydrochloric acid: 0.1 | 40 | 1 | 4.7 | 4.0 | 5.7 | 5.8 | ○ | INV. EX. |
| | | | | | 10 | 4.5 | 3.9 | 5.5 | 5.6 | ○ | INV. EX. |
| | | | | | 30 | 4.4 | 3.6 | 5.0 | 6.0 | ○ | INV. EX. |
| | | | Hydrochloric acid: 10 | 20 | 1 | 4.8 | 4.0 | 5.7 | 5.8 | ○ | INV. EX. |
| | | | | | 10 | 4.7 | 3.8 | 5.4 | 5.6 | ○ | INV. EX. |
| | | | | | 30 | 4.5 | 3.5 | 5.2 | 5.0 | ○ | INV. EX. |
| | | | Hydrochloric acid: 10 | 40 | 1 | 4.7 | 3.8 | 5.3 | 5.5 | ○ | INV. EX. |
| | | | | | 10 | 4.5 | 3.6 | 4.7 | 5.1 | ○ | INV. EX. |
| | | | | | 30 | 4.1 | 3.2 | 4.4 | 4.6 | ○ | INV. EX. |
| | | | Hydrochloric acid: 10 | 70 | 1 | 4.5 | 3.6 | 4.9 | 5.0 | ○ | INV. EX. |
| | | | | | 10 | 4.0 | 3.3 | 4.3 | 4.5 | ○ | INV. EX. |
| | | | | | 30 | 3.8 | 3.0 | 4.0 | 4.2 | ○ | INV. EX. |
| | | | Hydrochloric acid: 50 | 40 | 1 | 4.4 | 3.5 | 4.8 | 4.9 | ○ | INV. EX. |
| | | | | | 10 | 4.1 | 3.2 | 4.4 | 4.5 | ○ | INV. EX. |
| | | | | | 30 | 3.6 | 3.1 | 3.6 | 3.7 | ○ | INV. EX. |

TABLE 4-continued

| Pickling conditions | | | Repickling conditions | | | Overall width of peeling after corrosion test [mm] Temperature of chemical conversion treatment liquid | | | | | |
|---|---|---|---|---|---|---|---|---|---|---|---|
| | | | | | | 35° C. | | 33° C. | | | |
| | | | | | | Hot saline water | Saline water | Complex cycle | | | |
| Acid conc. [g/L] | Temp. [° C.] | Treatment time [sec] | Acid conc. [g/L] | Temp. [° C.] | Treatment time [sec] | immersion test | spray test | corrosion test | | Results | Remarks |
| | | | Hydrochloric acid: 100 | 40 | 1 | 5.6 | 4.3 | 6.6 | 6.8 | X | COMP. EX. |
| | | | | | 10 | 5.8 | 4.7 | 7.0 | 7.3 | X | COMP. EX. |
| | | | | | 30 | 5.9 | 5.0 | 7.3 | 7.5 | X | COMP. EX. |
| | | | Sulfuric acid: 0.1 | 40 | 1 | 4.8 | 4.0 | 5.8 | 5.9 | ○ | INV. EX. |
| | | | | | 10 | 4.6 | 3.9 | 5.5 | 5.6 | ○ | INV. EX. |
| | | | | | 30 | 4.5 | 3.8 | 5.2 | 5.3 | ○ | INV. EX. |
| | | | Sulfuric acid: 100 | 40 | 1 | 4.6 | 3.8 | 5.4 | 5.6 | ○ | INV. EX. |
| | | | | | 10 | 4.5 | 3.7 | 5.3 | 5.5 | ○ | INV. EX. |
| | | | | | 30 | 4.3 | 3.5 | 5.1 | 5.2 | ○ | INV. EX. |
| | | | Sulfuric acid: 150 | 40 | 1 | 4.7 | 3.6 | 5.3 | 5.2 | ○ | INV. EX. |
| | | | | | 10 | 4.4 | 3.4 | 4.7 | 4.8 | ○ | INV. EX. |
| | | | | | 30 | 4.1 | 3.2 | 4.3 | 4.5 | ○ | INV. EX. |
| | | | Sulfuric acid: 200 | 40 | 1 | 5.5 | 4.5 | 6.5 | 6.7 | X | COMP. EX. |
| | | | | | 10 | 5.6 | 4.8 | 7.2 | 7.3 | X | COMP. EX. |
| | | | | | 30 | 5.8 | 5.1 | 7.4 | 7.6 | X | COMP. EX. |

TABLE 5

| Pickling conditions | | | Repickling conditions | | | Overall width of peeling after corrosion test [mm] Temperature of chemical conversion treatment liquid | | | | | |
|---|---|---|---|---|---|---|---|---|---|---|---|
| | | | | | | 35° C. | | 33° C. | | | |
| | | | | | | Hot saline water | Saline water | Complex cycle | | | |
| Acid conc. [g/L] | Temp. [° C.] | Treatment time [sec] | Acid conc. [g/L] | Temp. [° C.] | Treatment time [sec] | immersion test | spray test | corrosion test | | Results | Remarks |
| Nitric acid: 150 + Hydrochloric acid: 15 | 40 | 10 | Hydrochloric acid: 0.1 | 40 | 1 | 4.9 | 4.0 | 5.9 | 5.8 | ○ | INV. EX. |
| | | | | | 10 | 4.6 | 3.9 | 5.6 | 5.7 | ○ | INV. EX. |
| | | | | | 30 | 4.5 | 3.6 | 5.2 | 6.0 | ○ | INV. EX. |
| | | | Hydrochloric acid: 10 | 20 | 1 | 4.9 | 4.0 | 5.8 | 5.9 | ○ | INV. EX. |
| | | | | | 10 | 4.7 | 3.8 | 5.5 | 5.7 | ○ | INV. EX. |
| | | | | | 30 | 4.6 | 3.5 | 5.2 | 5.2 | ○ | INV. EX. |
| | | | Hydrochloric acid: 10 | 40 | 1 | 4.7 | 3.8 | 5.2 | 5.6 | ○ | INV. EX. |
| | | | | | 10 | 4.5 | 3.6 | 4.8 | 4.9 | ○ | INV. EX. |
| | | | | | 30 | 4.1 | 3.2 | 4.4 | 4.5 | ○ | INV. EX. |
| | | | Hydrochloric acid: 10 | 70 | 1 | 4.5 | 3.6 | 4.9 | 4.9 | ○ | INV. EX. |
| | | | | | 10 | 4.2 | 3.3 | 4.3 | 4.6 | ○ | INV. EX. |
| | | | | | 30 | 3.9 | 3.0 | 4.1 | 4.3 | ○ | INV. EX. |
| | | | Hydrochloric acid: 50 | 40 | 1 | 4.4 | 3.5 | 4.9 | 4.7 | ○ | INV. EX. |
| | | | | | 10 | 4.0 | 3.3 | 4.4 | 4.5 | ○ | INV. EX. |
| | | | | | 30 | 3.6 | 3.0 | 3.7 | 3.7 | ○ | INV. EX. |
| | | | Hydrochloric acid: 100 | 40 | 1 | 5.3 | 4.4 | 6.8 | 6.9 | X | COMP. EX. |
| | | | | | 10 | 5.6 | 4.8 | 7.2 | 7.2 | X | COMP. EX. |
| | | | | | 30 | 5.7 | 5.0 | 7.4 | 7.5 | X | COMP. EX. |
| | | | Sulfuric acid: 0.1 | 40 | 1 | 4.9 | 4.0 | 5.7 | 5.9 | ○ | INV. EX. |
| | | | | | 10 | 4.6 | 3.9 | 5.4 | 5.6 | ○ | INV. EX. |
| | | | | | 30 | 4.4 | 3.8 | 5.2 | 5.3 | ○ | INV. EX. |
| | | | Sulfuric acid: 100 | 40 | 1 | 4.7 | 3.9 | 5.5 | 5.7 | ○ | INV. EX. |
| | | | | | 10 | 4.6 | 3.7 | 5.2 | 5.3 | ○ | INV. EX. |
| | | | | | 30 | 4.2 | 3.3 | 5.0 | 5.2 | ○ | INV. EX. |
| | | | Sulfuric acid: 150 | 40 | 1 | 4.7 | 3.6 | 5.3 | 5.3 | ○ | INV. EX. |
| | | | | | 10 | 4.4 | 3.3 | 4.7 | 4.9 | ○ | INV. EX. |
| | | | | | 30 | 4.2 | 3.1 | 4.1 | 4.7 | ○ | INV. EX. |
| | | | Sulfuric acid: 200 | 40 | 1 | 5.5 | 4.5 | 6.5 | 6.8 | X | COMP. EX. |
| | | | | | 10 | 5.6 | 4.8 | 7.0 | 7.4 | X | COMP. EX. |
| | | | | | 30 | 5.8 | 5.2 | 7.4 | 7.6 | X | COMP. EX. |

The results in Tables 2, 4 and 5 show that the steel sheets from INVENTIVE EXAMPLES which had been strongly pickled and repickled after continuous annealing under the conditions conforming to this invention achieved good post-coating corrosion resistance and exhibited small values of maximum overall peeling widths in all of the hot saline water immersion test, the saline water spray test, and the complex cycle corrosion test.

Figure 3:
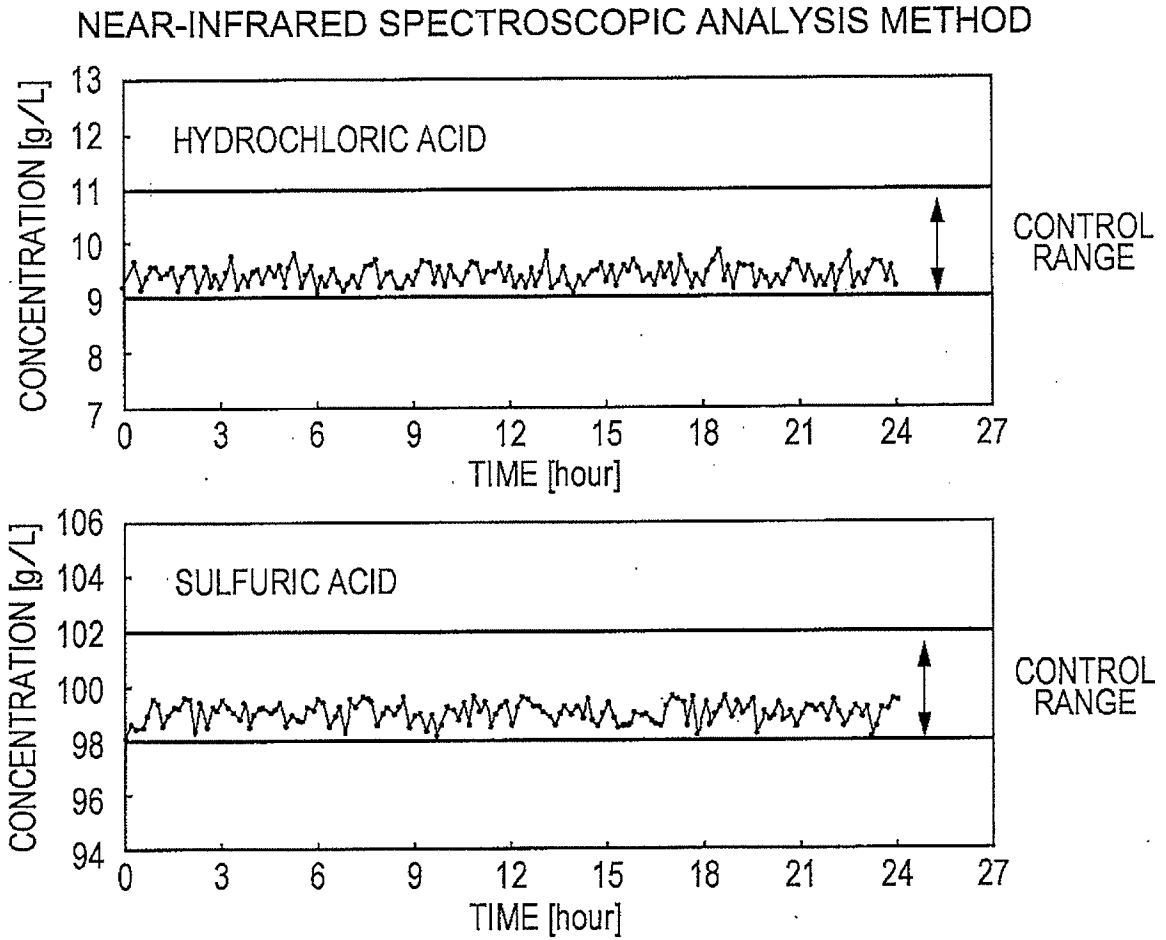
FIG. 3 illustrates time charts indicating trends of acid concentrations, in a repickling solution during an exemplary manufacturing of steel sheets utilizing a near-infrared spectroscopic analysis method shown in Table 2.
Figure 5:
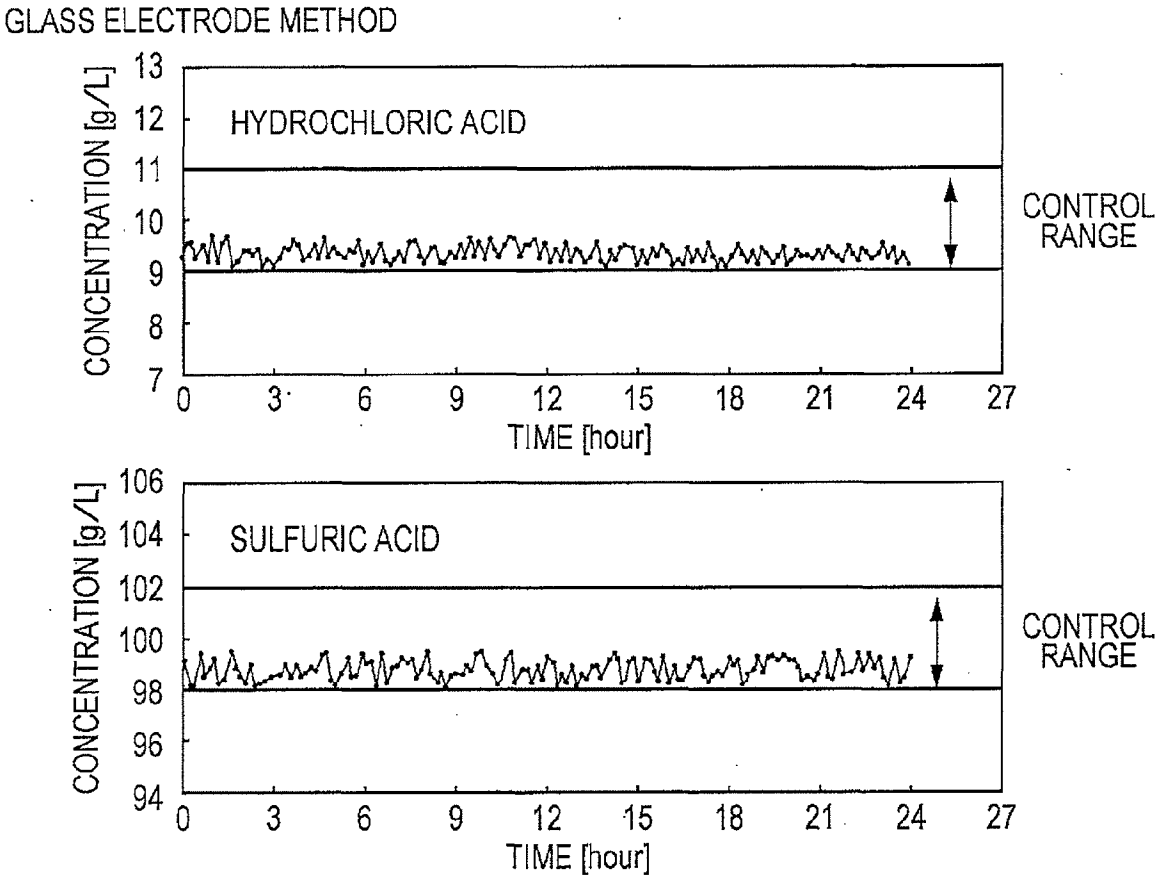
FIG. 5 illustrates time charts indicating trends of acid concentrations in a repickling solution during an exemplary manufacturing of steel sheets utilizing a glass electrode method shown in Table 4.
Figure 6:
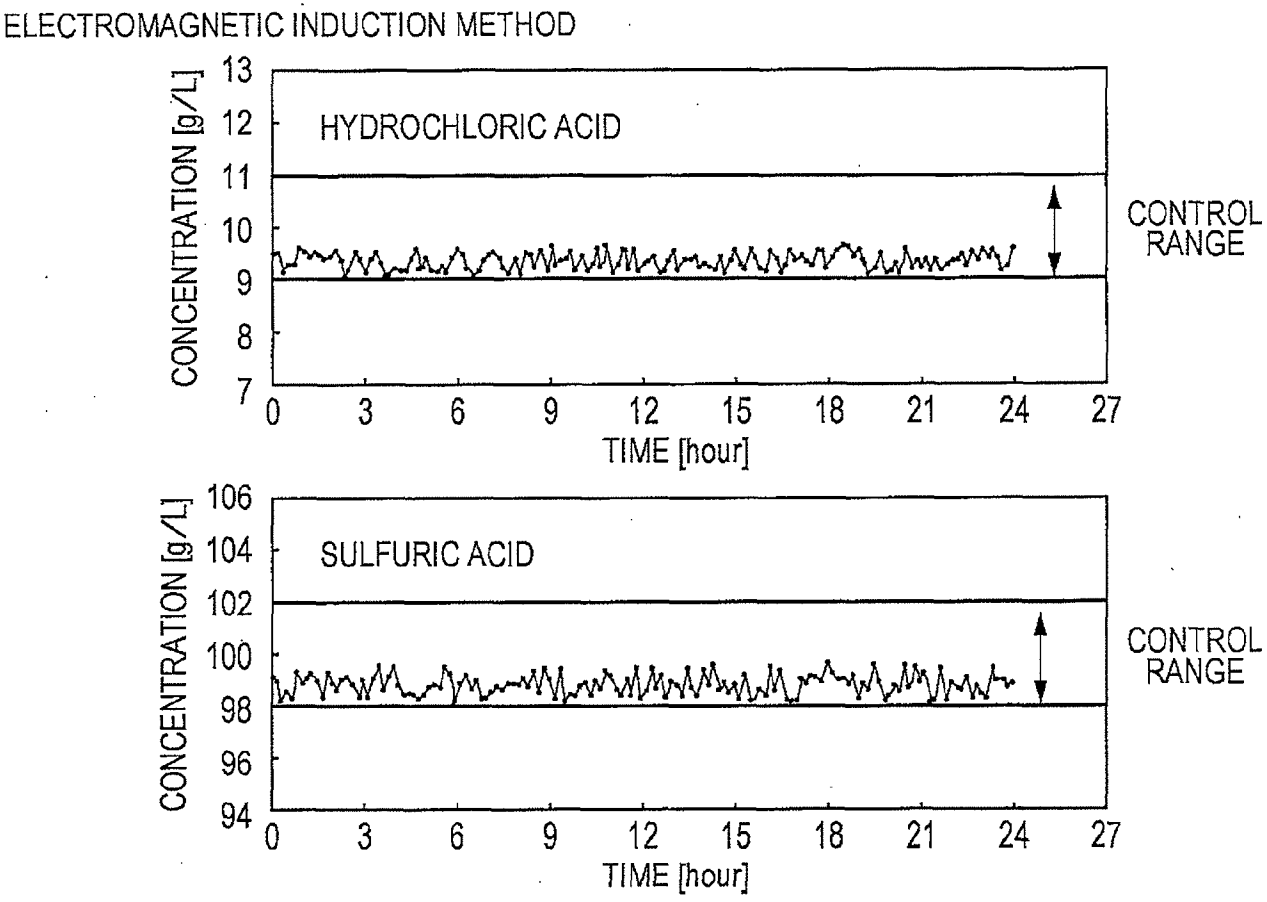
FIG. 6 illustrates time charts indicating trends of acid concentrations in a repickling solution during an exemplary manufacturing of steel sheets utilizing an electromagnetic induction method shown in Table 5.

FIGS. 3, 5 and 6 illustrate trends of acid concentrations in the repickling tank 12 during the manufacturing of steel sheets under the repickling conditions with 10 g/L hydrochloric acid and with 100 g/L sulfuric acid shown in Tables 2, 4 and 5, respectively. Control ranges for the target hydrochloric acid concentration of 10 g/L and for the target sulfuric acid concentration of 100 g/L in the repickling tank 12 were 9 to 11 g/L and 98 to 102 g/L, respectively. As illustrated in all of FIGS. 3, 5 and 6, both the concentrations of hydrochloric acid and sulfuric acid were stable near the lower limit of the control range without getting out of the control range.

On the other hand, good post-coating corrosion resistances were generally obtained by using the titration method as shown in Table 3. However, the corrosion resistances were poor under three repickling conditions, namely, when (1) the hydrochloric acid concentration was 10 g/L, the temperature was 40° C. and the treatment time was 10 seconds, (2) the hydrochloric acid concentration was 10 g/L, the temperature was 70° C. and the treatment time was 30 seconds, and (3) the sulfuric acid concentration was 100 g/L, the temperature was 40° C. and the treatment time was 10 second, in spite of the fact that these acid concentrations, temperatures and treatment times satisfied the inventive conditions.

Figure 4:
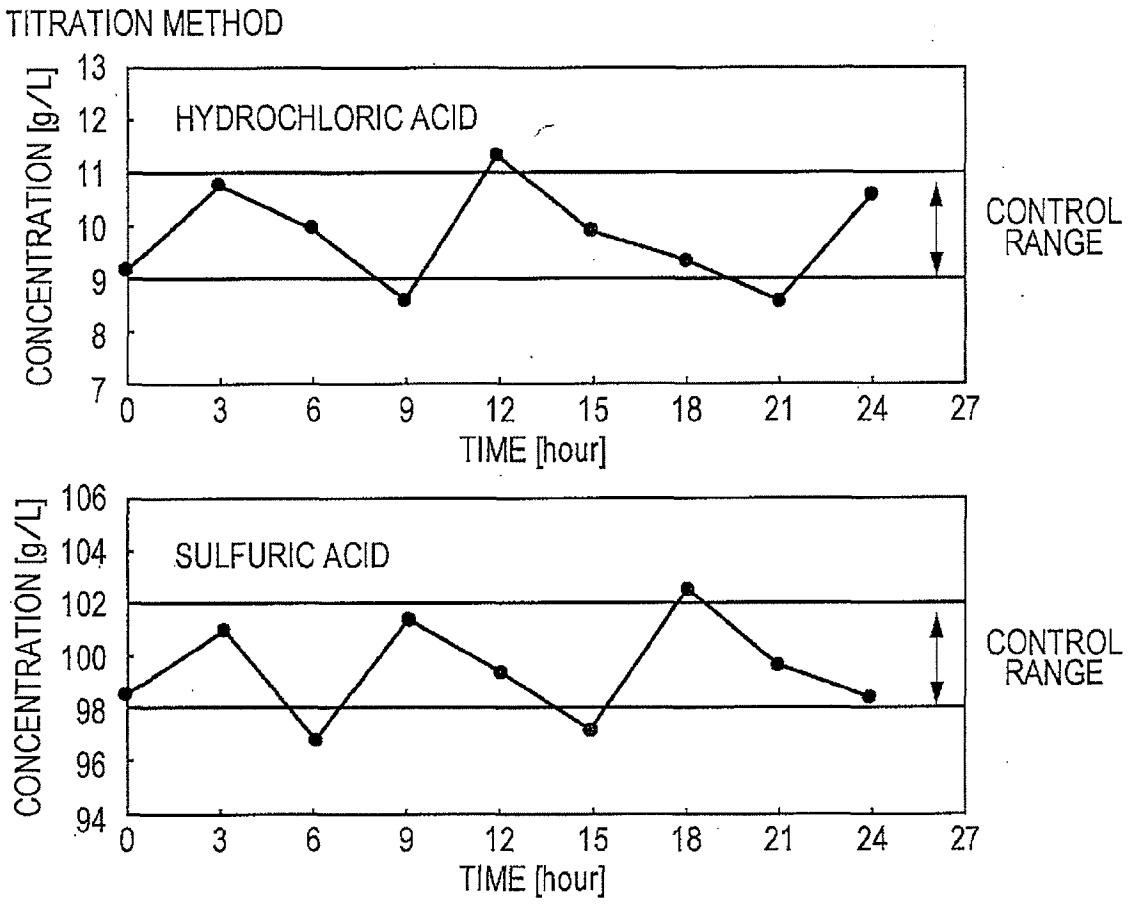
FIG. 4 illustrates time charts indicating trends of acid concentrations in a repickling solution during manufacturing of steel sheets utilizing a conventional titration method shown in Table 3.

FIG. 4 illustrates trends of acid concentrations in the repickling tank 12 during the manufacturing of steel sheets under the repickling conditions with 10 g/L hydrochloric acid and with 100 g/L sulfuric acid shown in Table 3. Control ranges for the target hydrochloric acid concentration of 10 g/L and for the target sulfuric acid concentration of 100 g/L in the repickling tank 12 were 9 to 11 g/L and 98 to 102 g/L, respectively. As illustrated in FIG. 4, both the concentrations of hydrochloric acid and sulfuric acid got out of the control range.

The timings at which the steel sheets were manufactured under the three conditions shown in Table 3 that exhibited poor post-coating corrosion resistances were examined against the acid concentration trends in FIG. 4. It was found that the acid concentration was below the lower limit in FIG. 4 when the production took place under the three conditions that exhibited poor post-coating corrosion resistances.

As demonstrated above, the titration method entails long intervals between measurements of acid concentration, which makes it difficult to control the acid concentration and often caused the acid concentration to get out of the control range. Because of this, chemical conversion properties are deteriorated, and running costs are increased due to the excessive addition of acids.

As demonstrated above, this invention makes it possible to maintain the concentration of a repickling solution at a low level in a control range. Consequently, manufacturing of Si-containing cold rolled steel sheets with excellent chemical conversion properties has become feasible even when a chemical conversion treatment solution is used at a lower temperature while minimally suppressing the formation of sludge, avoiding excessive consumption of acids, and saving running costs.

REFERENCE SIGNS LIST

10 . . . STRONG PICKLING TANK
12 . . . REPICKLING TANK
20 . . . ACID STOCK TANK
22, 26 . . . PUMPS
24 . . . CIRCULATION TANK
28 . . . FILTER
30 . . . ANALYZER
40 . . . CONTROL UNIT
50 . . . SWITCHING VALVE

The invention claimed is:

1. A method for manufacturing Si containing cold rolled steel sheets with excellent chemical conversion properties, comprising steps of:

cold rolling a steel sheet containing 0.5 to 3.0 mass % Si, continuously annealing the cold rolled steel sheet, pickling a surface of the continuously annealed cold rolled steel sheet, and repickling the surface of the pickled steel sheet with a non-oxidative acid, wherein the repickling is performed such that:

a repickling solution is sampled continuously or periodically;

an acid concentration in the sampled solution is measured; and the acid concentration in the repickling solution is regularly controlled within a prescribed concentration range.

2. The method for manufacturing Si containing cold rolled steel sheets according to claim 1, wherein:

the acid concentration in the repickling solution is measured by one of a near infrared spectroscopic analysis method, a glass electrode method, and an electromagnetic induction method.

3. The method for manufacturing Si-containing cold rolled steel sheets according to claim 1, wherein:

the acid concentration in the sampled repickling solution is measured after the sampled solution is passed through a filter.

4. The method for manufacturing Si containing cold rolled steel sheets according to claim 3, wherein:

a pore diameter of the filter is not less than 20 μm and not more than 30 μm.

5. The method for manufacturing Si containing cold rolled steel sheets according to claim 1, wherein:

the acid used in the repickling is one of hydrochloric acid, sulfuric acid, phosphoric acid, pyrophosphoric acid, formic acid, acetic acid, citric acid, hydrofluoric acid, oxalic acid, and a mixture of two or more thereof.

6. The method for manufacturing Si containing cold rolled steel sheets according to claim 1, wherein:

the acid used in the repickling is one of hydrochloric acid with a concentration of 0.1 to 50 g/L, sulfuric acid with a concentration of 0.1 to 150 g/L, and a mixture of hydrochloric acid and sulfuric acid with respective concentrations of 0.1 to 20 g/L and 0.1 to 60 g/L.

7. The method for manufacturing Si containing cold rolled steel sheets according to claim 1, wherein:

the repickling is performed at a temperature of the repickling solution of 20 to 70° C. for a repickling time of 1 to 30 seconds.

8. The method for manufacturing Si containing cold rolled steel sheets according to claim 1, wherein:

the pickling is performed using a pickling solution that is one of a mixture of nitric acid and hydrochloric acid with respective concentrations of above 50 g/L and not more than 200 g/L and above 1 g/L and not more than 200 g/L, and a mixture of nitric acid and hydrofluoric acid with respective concentrations of above 50 g/L and not more than 200 g/L and above 1 g/L and not more than 200 g/L.

9. The method for manufacturing Si containing cold rolled steel sheets according to claim 1, wherein:

the acid concentration in the pickling solution is measured with a lower accuracy and/or at a longer interval compared with an accuracy and an interval for measuring the acid concentration in the repickling solution.

10. An apparatus for manufacturing Si containing cold rolled steel sheets with excellent chemical conversion properties, comprising:

a pickling tank for pickling a surface of a steel sheet that is cold rolled and continuously annealed, a repickling tank for repickling the surface of the pickled steel sheet with a non-oxidative acid, a measurement unit that continuously or periodically samples a repickling solution and measures an acid concentration in the sampled solution, and a unit for regularly controlling the acid concentration in the repickling tank within a prescribed concentration range based on the measured results.

11. The apparatus for manufacturing Si containing cold rolled steel sheets according to claim 10, wherein:

the measurement unit utilizes one of a near infrared spectroscopic analysis method, a glass electrode method, and an electromagnetic induction method.

12. The apparatus for manufacturing Si-containing cold rolled steel sheets according to claim 10, wherein:

the measurement unit includes a filter for removing suspended solids before the acid concentration in the sampled solution is measured.

13. The apparatus for manufacturing Si-containing cold rolled steel sheets according to claim 12, wherein:

a pore diameter of the filter is not less than 20 μm and not more than 30 μm.

14. The apparatus for manufacturing Si-containing cold rolled steel sheets according to claim 10, wherein:

the acid used in the repickling is one of hydrochloric acid, sulfuric acid, phosphoric acid, pyrophosphoric acid, formic acid, acetic acid, citric acid, hydrofluoric acid, oxalic acid, and a mixture of two or more thereof.

15. The apparatus for manufacturing Si-containing cold rolled steel sheets according to claim 10, wherein:

the acid used in the repickling is one of hydrochloric acid with a concentration of 0.1 to 50 g/L, sulfuric acid with a concentration of 0.1 to 150 g/L, and a mixture of hydrochloric acid and sulfuric acid with respective concentrations of 0.1 to 20 g/L and 0.1 to 60 g/L.

16. The apparatus for manufacturing Si-containing cold rolled steel sheets according to claim 10, wherein:

the repickling is performed at a temperature of the repickling solution of 20 to 70° C. for a repickling time of 1 to 30 seconds.

17. The apparatus for manufacturing Si-containing cold rolled steel sheets according to claim 10, wherein:

the pickling is performed using a pickling solution that is one of a mixture of nitric acid and hydrochloric acid with respective concentrations of above 50 g/L and not more than 200 g/L and above 1 g/L and not more than 200 g/L, and a mixture of nitric acid and hydrofluoric acid with respective concentrations of above 50 g/L and not more than 200 g/L and above 1 g/L and not more than 200 g/L.

18. The apparatus for manufacturing Si-containing cold rolled steel sheets according to claim 10, wherein:

an acid concentration in the pickling solution is measured with a lower accuracy and/or at a longer interval compared with an accuracy and an interval for measuring the acid concentration in the repickling solution.

* * * * *